United States Patent [19]

Roehl

[11] Patent Number: 4,690,328

[45] Date of Patent: Sep. 1, 1987

[54] SPRAYING MACHINE

[75] Inventor: Franz Roehl, Frankfurt am Main, Fed. Rep. of Germany

[73] Assignee: Bentonspritz Nascgubeb GmbH Co., Fed. Rep. of Germany

[21] Appl. No.: 762,655

[22] Filed: Aug. 5, 1985

[51] Int. Cl.[4] ..... B05B 3/00

[52] U.S. Cl. ..... 239/227; 239/288; 239/587; 239/722; 280/43.12

[58] Field of Search ..... 239/227, 587, 146, 172, 239/273, 286, 287, 164–166, 661, 288; 414/446, 498, 608; 280/43.12, 47.33

[56] References Cited

U.S. PATENT DOCUMENTS

| | | | |
|---|---|---|---|
| 2,761,522 | 9/1956 | Paradiso et al. | 414/608 X |
| 2,829,896 | 4/1958 | Swenson | 239/661 X |
| 3,729,215 | 4/1973 | Paakkinen | 414/608 X |
| 3,957,203 | 5/1976 | Bullard | 239/165 X |
| 4,007,793 | 2/1977 | Hux et al. | 239/166 X |
| 4,013,518 | 3/1977 | Miko | 239/227 X |
| 4,047,698 | 9/1977 | Ellis | 280/43.12 X |
| 4,128,207 | 12/1978 | Pacht et al. | 239/227 X |
| 4,222,522 | 9/1980 | Kubo et al. | 239/165 X |

FOREIGN PATENT DOCUMENTS 3037182 9/1986 Fed. Rep. of Germany .

*Primary Examiner*—Andres Kashnikow
*Assistant Examiner*—Daniel R. Edelbrock
*Attorney, Agent, or Firm*—Ralph R. Rath

[57] ABSTRACT

A spraying device consists of a frame having an arm universally-pivoted thereon which has a spray nozzle at the outer end. The frame is designed to be supported on a forklift-type truck having a fork movable thereon. The frame has retaining elements for receiving and supporting the fork and the arm is received through pneumatic cylinders. The arm has first and second parts which are rotated relative to each other by a pneumatic motor.

14 Claims, 6 Drawing Figures

100
102
104
110
110a
144a
144a'
144b
144b'
148
148'
150
158
160a
160b
160c
162
164
166a
166b
168
170
172
174
176
178
180
182
184
186
188
190
192
194
196
198

SPRAYING MACHINE

TECHNICAL FIELD

The present invention relates generally to transport devices and, more particularly, to a device for moving and guiding an application nozzle.

BACKGROUND PRIOR ART

The use of portable spraying devices has been common for years in many industries. Many of these devices are mounted on powered vehicles for movement from one site to another.

For example, German Patent No. DE-PS 30 37 182 discloses a device for mechanically guiding a spray nozzle, more particularly for applying air-placed concrete. The device is brought by transport means to the place of use, where it remains. The arm has a telescopingly extendable prolongation for applying concrete at variable distances from the device. The known device is inexpensive and space-saving and is equipped exclusively with pneumatic drive elements enabling the device to be manipulated very easily, appropriately for its purpose, via a singlehanded lever. The known device is suitable, for example, for spraying conrete onto tunnel arches or embankments, where it is used under normal temperature conditions.

In the steel industry, it is regularly necessary to repair the refractory linings of melting crucibles and melting pots after use; for technical and economic reasons, it is usually impossible to wait until the crucible has sufficiently cooled before starting repairs. Consequently, linings are repaired by using spray lances of adequate length, enabling the staff to carry out repair work from a sufficient distance from the crucibles, which are often still at temperatures above 1000° C. Of course, these lances can only have a small useful spray cross-section; if they are to be manipulated manually by one operator.

On the other hand, the platforms used for making repairs on crucibles are of limited size, so that it is impossible to use large, complicated devices. Admittedly, there is a known heavy hydraulic device for repairing the aforementioned refractory linings, but in most cases it cannot be used owing to lack of space and the disproportionately high cost.

SUMMARY OF THE INVENTION

The object of the invention is to provide a device for guiding an applicator nozzle, which has the advantages of the known concrete spraying device according to German Patent No. DE-PS 30 37 182, i.e. relatively small dimensions, low weight and pneumatic drive means for simple manipulation, but can easily be brought to the platforms for repairing casting ladles, where it can be moved in a small space, can withstand the very high temperatures and is also easy to control.

The invention relates to a device for guiding an applicator nozzle, more particulary for repairing refractory linings, comprising an arm pivoted on a stationary frame at a base end remote from the nozzle so that the arm can move through any angle in space, and two pneumatic working cylinders pivoted at one end to the arm, the cylinder bases forming a support triangle on the base and being pivoted to the frame so that they can move through any angle in space.

According to the present invention, the frame is disclosed on the form of a commercially available electrically drivable pallet truck and an electric drive means is provided for actuating the pneumatic working cylinder for pivoting the arm while a pneumatic drive is provided for rotating the arm around its longitudinal axis.

Conventional commercial pallet trucks are advantageously used. These have a hand-operated lifting part, a drive wheel disposed near the lifting part, and jack wheels near the fork. The lifting part is pivotedly connected to a beam or bracket connecting the fork so that the truck is movable not only along a straight track forwards and backwards, but can also be moved along curved paths. A pallet truck of this kind is sold, e.g. by Messrs. BT Transportgerate GmbH, of 3004 Iserhagen 1, Berliner Strasse 4, under the desingation BT ML 1200 or BT ML 1200B.

The truck has small dimensions and is therefore very suited for working on platforms with very small working areas. The frame and arm on the truck can be guided and thereby easily brought into position relative to the refractory linings to be repaired. The guide means can also be locked to ensure that the truck, after taking up position, can be moved only forward and back along an invariable path.

Since the frame can be driven by a conventional pallet truck, there is no need in most cases for a telescopic arm, thus considerably reducing the cost of manufacturing the device.

Cost is also saved by the fact that pneumatic drive cylinders are used instead of hydraulic drive means. All the drives of the device are pneumatic, thus eliminating more expensive hydraulic units, and the air connection already available for the drives can also be used in a very simple manner for cooling the entire device, making maximum use of the waste air from the pneumatic drives for cooling. A device with hydraulic drive, on the other hand, would need at least one additional separate air-cooling system.

In one embodiment of the invention, the frame has retaining elements at its underside for engaging the forks of the truck. The frame should have wheels on opposite sides near the retaining elements and one or more telescopic and lockable jack devices or support means on the side of the frame remote from the wheels. When the frame is released from the truck, it rests on its wheels and on the extended jack devices, which are in the locked position. In order to connect the truck to the frame, the fork is lowered and driven under the frame until it engages the retaining elements disposed on the underside of the frame. The fork is then lifted until the wheels on the axle rise slightly from the ground and the pressure on the jack is also relieved. The jack is then retracted and the fork is lowered. In the lowered position, the bottom end of the fork is in positive engagement with the retaining elements, the frame comes to rest on the fork and the unit comprising the fork and the frame is supported on the ground by the frame wheels on the axle and the drive wheel of the truck. In this position, the jack wheels are retracted.

Advantageously, the fork includes two transversely-spaced arms and the frame is rectangular and has a pair of U-shaped elements at one end that define slots which receive the ends of the fork arms. To ensure that the arms can engage the U-shaped elements in a predetermined position, the extendable jack wheels should be disposed at a distance from the free ends of the arm. Of course, the fork can have more than two arms. According to the invention, the U-shaped elements can be replaced by a number of such elements which correspond to the number of arms.

The two pneumatic working cylinders of the arms and the base of the arm remote from the applicator nozzle are mounted in the frame. A pneumatic jack cylinder can also be provided, engaging the frame arm and adjustable to a constant braking force relative to the frame. The jack cylinder should advantageously engage the arm near the foot thereof remote from the applicator nozzle.

A pneumatic drive is provided for rotating the arm around its longitudinal axis. It is thus possible to eliminate expensive hydraulic drives or electric drives, and the expended air from the pneumatic drive can be used for cooling the device. Advantageously, the arm has a first part, one end of which is secured to the frame so that it can rotate through any angle in space, whereas its other end is supported by the two pneumatic working cylinders and a second part of the arm is rotatably-mounted in the first part and bears the line for spraying the applied material and also a cooling-air line, if required. In certain cases, in addition to moving the device on the pallet truck, it may be desirable to have another facility for moving the nozzle in the longitudinal direction of the device. In that case, the second part of the arm could be telescopingly extendable and retractable in the first part through a fluid ram.

The device according to the invention can be manipulated in a particularly simple manner if electricity is used, more particularly via a common control panel for controlling the motion of the pallet truck, for actuating the pneumatic working cylinders for pivoting the arm, and for the drive for rotating the arm. If, owing to the use to which the device is put, it is desirable to operate it from a place different from the place of installation, e.g. to obtain a better view of the course of operations, the device can have a removable control panel connected to the device by a control line.

Finally, a heat shield is disposed on the side remote from the nozzle of the pneumatic drive for rotating the arm and the pneumatic cylinder for pivoting the arm.

BRIEF DESCRIPTION OF SEVERAL VIEWS OF DRAWINGS

DETAILED DESCRIPTION

Figure 1:
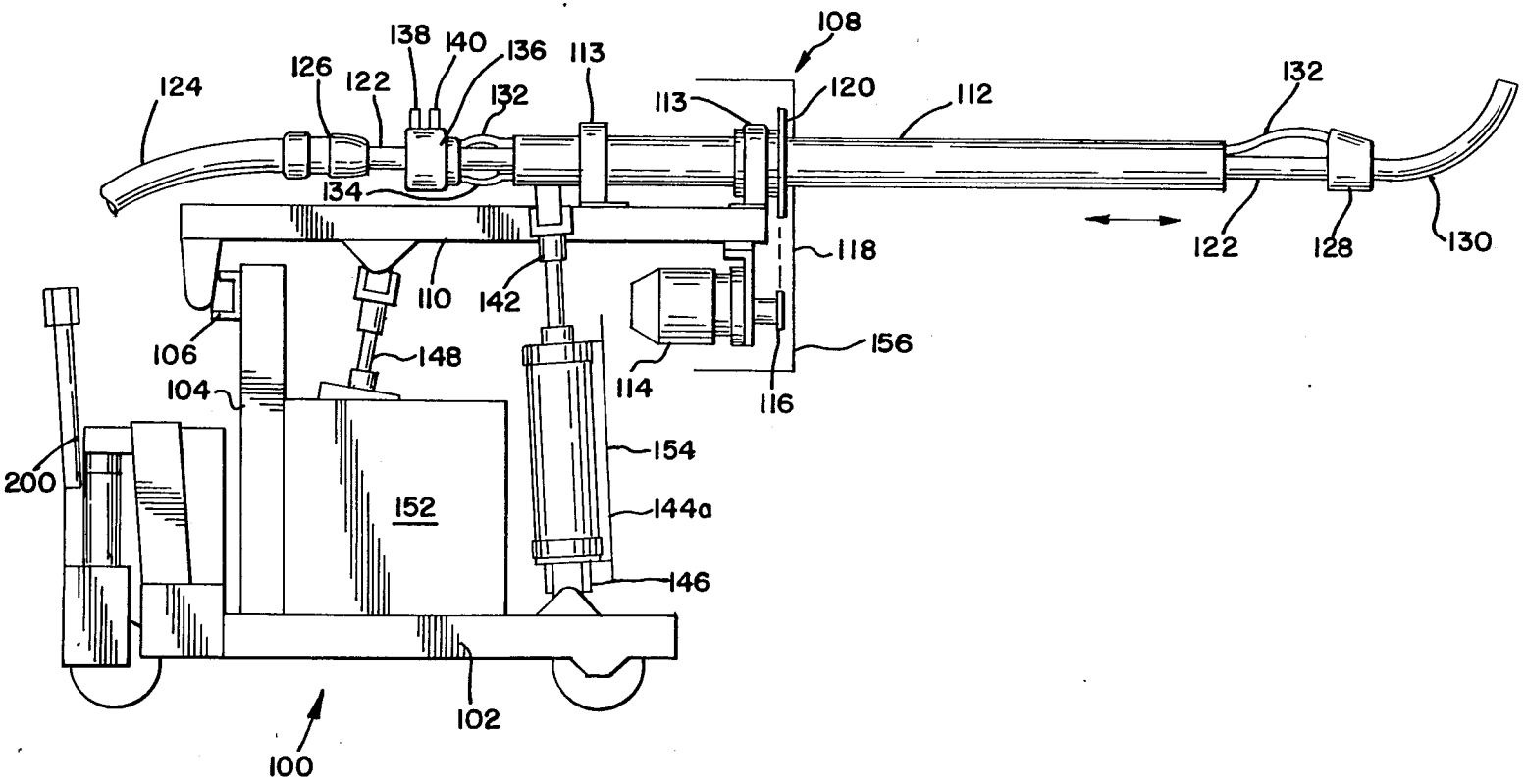
FIG. 1 is a side view of the device constructed in accordance with the invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 is a diagram of the device for guiding an applicator nozzle, more particularly for repairing refractory linings, comprising a frame 100 made up of a base frame 102 and a vertical end part 104, braced if required, by oblique reinforcements. The base of an arm 108 is pivoted by a joint 106 to the free end of part 104 and, apart from limiting abutments on the frame (not shown), can move freely in all directions, i.e., has universal pivotal movement on the frame. Arm 108 comprises a first part 110 pivoted to frame 100 and a second part 112 mounted on the first part, the second part being rotatably received by two bearings 113 disposed on the top of part 110. A pneumatically-driven motor 114 is disposed under part 110. A pinion 116 on output shaft of motor 114 drives a gearwheel 120 on part 112 via a chain 118 and thus enables part 112 to rotate with respect to part 110.

A spray line 122 extends inside part 112. The frame end of line 122 is connected by a coupling 126 to a hose 124. The free end of part 112 has a spray nozzle 128 which is releasably secured to a mouthpiece 130, which is constructed with a desired curvature and can be exchanged for other such configurations. A water pipe 132 and an air supply pipe 134 extend through part 112. Pipes 132 and 134 both open into a distribution ring 136 surrounding the spray line 122 and distribution ring has a connecting nozzle 138 for water and a connecting nozzle 140 for air. Water is supplied through pipe 132 and part 112 to nozzle 128, whereas the air supply pipe 134 opens into the space between line 122 and part 112 and thus cools both these parts. Near the end of part 112, remote from frame 100, air comes out of part 112 and cools nozzle 128 and mouthpiece 130 indirectly.

A transverse bearing member 142 is secured to part 110 at a certain distance from joint 106. Two pneumatic working cylinders or fluid rams **144*a* and 144*b* (only cylinder 144*a* is shown in FIG. 1) are pivoted near the free end of member 142 and their lower ends are pivoted in a laterally-spread position to base frame 102 via pivot joints 146. A jack cylinder or fluid ram 148 engages the underside of part 110 and its bottom end is pivotably secured to the rear end of base frame 102. Cylinder 148 is used only for additionally relieving the weight of arm 108. Arm 108 can be adjusted sideways and vertically only by actuating the pneumatic working cylinders 144*a* and 144*b*. Note that joints 106 and 146 (although not directly shown in FIG. 1) are double or universal joints movable in all directions so that arm 108** can be pivoted vertically and sideways.

Figures 2, 3, 4:
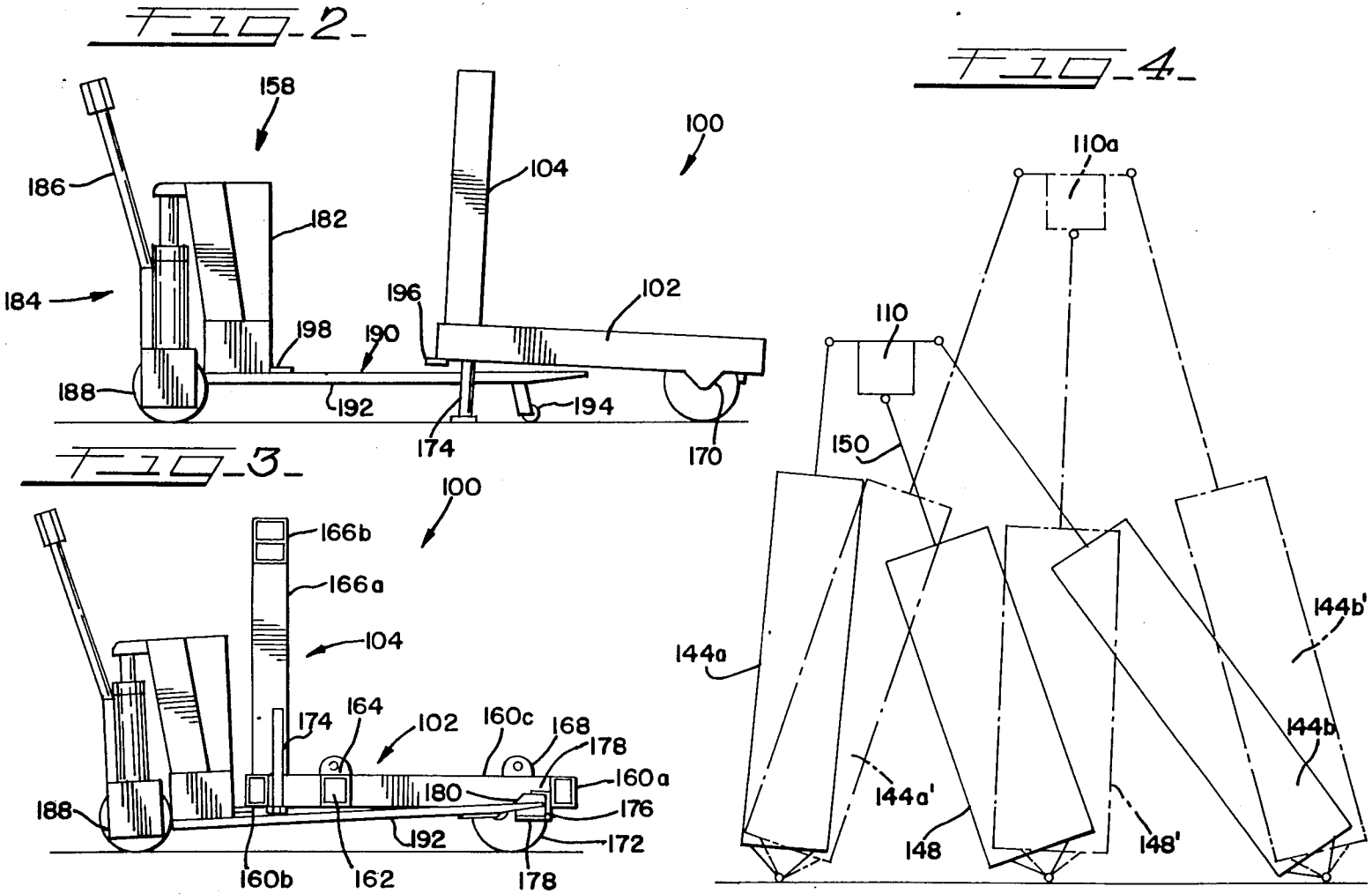
FIG. 2 is a diagrammatic side view of the truck and the frame when the truck is moved out of the frame.
FIG. 3 is a view corresponding to FIG. 2 when the truck has been driven into the frame.
FIG. 4 is a diagram of the main drive elements of the device in front view, showing how the arm can be pivoted sideways and vertically.

The lateral and vertical pivotability of arm 108 is shown in FIG. 4, which is a diagrammatic front view of the arrangement of the cylinders in FIG. 1. In order to move from the solid-line position to the dotted line position, cylinder **144*a* must be extended into position 144*a*' and cylinder 144*b* into position 144*b*', but at a different speed. The piston rod 150 of jack cylinder 148 must be capable of adapting to these changes in position, but the pressure inside it must be kept constant to maintain a constant bracing force through cylinder 148. Cylinders 144*a* and 144*b* must be simultaneously extended in order to raise arm 108 and simultaneously retracted to lower it. Arm 108** can be pivoted sideways only by extending one of the two working cylinders and retracting the other in a predetermined ratio to one another.

A casing 152 containing control valves, actuable in a manner to be described hereinafter, is disposed on base frame 102 away from the center, near the vertical part 104. The required pneumatic connections are not shown in FIG. 1. The device also has a heatshielding means. The means substantially comprise a front heat shield 154 disposed in front of cylinders 144*a*, 144*b* and a heat shield 156 disposed in front of pneumatic motor 114, pinion 116 and gearwheel 120. As shown by a double arrow near the second part 112 of arm 108, part 112 can, if desired, be reciprocable on the first part in the longitudinal direction thereof. It is only necessary to provide an additional drive, such as a pneumatic cylinder, for moving part 112 on part 110.

With regard to the subsequent description, special reference is made to FIGS. 2 and 3. These, in constract to FIG. 1, show in detail the construction of a commercially-available pallet truck 158 and the manner of interconnecting the truck and the frame 100. FIG. 2 shows truck 158 and frame 100 in side view when the truck has been substantially driven out of the frame, whereas FIG. 3 shows a longitudinal section through the truck driven into the frame. Frame 100 is shown in simplified form, i.e. the drawing omits cylinders 144*a* and 144*b*, jack cylinder 148, casing 152 and details of the arm 108.

The frame base 102 is rectangular frame and includes four hollow bearing members of rectangular cross-section, i.e. a front member 160*a*, a rear member 160*b* and two side members 160*c*. A hollow bearing member 162 of rectangular cross-section is disposed between members 160*c* and near member 160*b*, and centrally supports the frame-side bearing 164 of jack cylinder 148. Casing 152 is disposed in conventional manner on member 162 between bearing 164 and member 160*c*. End part or upright 104 comprises two substantially vertical hollow bearing members 166*a* of rectangular cross-section secured to member 160*b*, and a horizontal hollow bearing member 166*b* of rectangular cross-section connecting the upper ends of the two members 166*a*. Joint 106 for arm 108 is disposed centrally on member 166*b*. The alignment of members 166*a* can be vertical, or they can be inclined to one another, thus shortening member 166*b*. The two bearings 168 for cylinders 144*a*, 144*b* are disposed on the top side of members 160*c* near member 160*a*.

A bearing 170 for a wheel or ground-engaging means 172 is disposed on each side of members 160*c*. The bearing axle and the diameter of wheels 172 are made such that the base frame 102 near the wheels is at a distance from the ground enabling the fork of a conventional pallet truck to be driven under base frame 102. Finally, members 160*b* have telescopic jacks or extensible support means 174 near member 160*b* and securable in the desired position by locking means (not shown). Drive wheel 188 is pivoted on frame 182 and has steering means associated therewith. The steering means may be in the form of a steering pole (not shown) for pivoting the wheel with the steering means being lockable in a central position for straight driving so that the truck can be remotely controlled. A bearing member 176 is connected to member 160*a* between members 160*b* in the lower region of member 160*a*, on the side thereof facing member 160*b*. Member 176 is U-shaped and defines a slot 178 that extends towards member 160*b*. The web 180 of member 176 is connected to member 160*a*.

Truck 158 is electric and hand-operated in conventional manner. A lifting unit 184 and linkage 186 are connected to frame 182 of truck 158. Unit 184 has a drive wheel 188 driven by an electric motor (not shown). Truck 158 also has a brake (not shown). Linkage 186 can be used in conventional manner to guide the truck 158 and also to raise frame 182. A fork 190, comprising two arms 192, is disposed on the underside of frame 182. Extendable jack wheels 194 are provided at a distance from the free ends of arms 192.

Before truck 158 is driven into frame 100, frame 100 is in the position shown in FIG. 2. Jacks 174 have been extended until the underside of base frame 102 is inclined slightly upwards away from wheels 172. Truck 158 is driven under frame 102, and during the process, fork 190 is raised until the free ends of arms 192 are received into slots 178 defined by members 176 and the end of arm 192 abuts web 180.

Linkage 186 is then actuated so as to raise arms 192 further, so that the pressure is taken off jacks 174 and bearing plates or retaining elements 196 secured to the underside of base frame 102 come to rest on corresponding bearing plates or retaining elements 198 disposed on arms 192. Jacks 174 are then retracted and locked in the retracted position. After frame 182 has been lowered, a positive connection is produced between frame 100 and truck 158 in that the undersides of the free ends of arms 192 abut the corresponding web of member 176. The unit formed by frame 100 and truck 158 rests on wheels 172 and drive wheel 188 on the ground. The drawing does not show means which may be required for connecting frame 100 to truck 158. However, various types of self-release connections could be used. For example, retaining elements 196 and 198 could be ball-and-socket arrangements. Alternatively, friction between frame 100 and fork 190 could also be relied upon as the retaining element.

Figure 5:
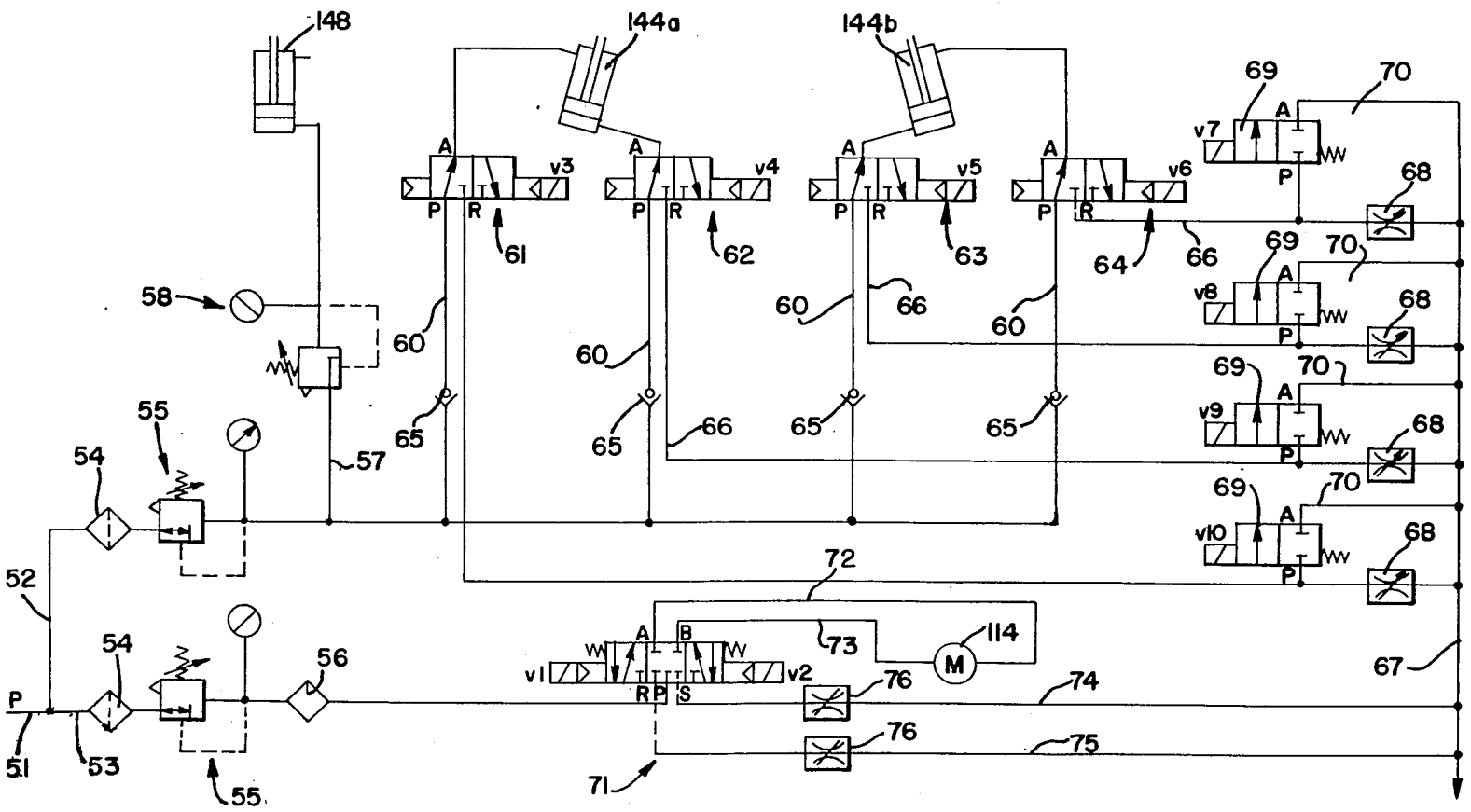
FIG. 5 is a pneumatic circuit diagram for the drive of the device in FIG. 1; and, FIG. 6 is a diagram of the electric components of the device of FIG. 1.

While not believed to be necessary for understanding the present invention, FIG. 5 shows the circuit diagram for all pneumatic drives of the device according to the invention in FIGS. 1–4. A compressed-air supply line 51 is divided into compressed-air lines 52 and 53. Line 52 is for actuating or driving the jack cylinder 148, which is actuated from one end, and the double-acting working cylinders 144*a* and 144*b* whereas line 53 actuates and drives motor 114 for rotating the spray nozzle or applicator 128. Line 52, 53 both have filters 54 and pressure-reducers 55. Line 58 also has an oil cup 56. The pressure chamber of jack cylinder 148 is connected to line 52 via a compressed-air line 57, containing a regulating valve 58.

Each each of the chamber of cylinders 144*a* and 144*b* is connected by compressed-air lines 60 to line 52. Lines 60 have control valves 61, 62, 63 and 64, and lines 60 have one-way check valves or non-return valves 65 between the control valves and line 52. Valves 61, 62, 63 and 64 are also connected to vent lines 66 terminating in a main vent line 67. The vent lines 66 contain pressure regulators 68. In order to drive the pistons of cylinders 144*a* or 144*b* at higher speed, pressure regulators 68 can be bypassed by control valves 69. When valves 69 are closed, compressed air flows through vent lines 66 and pressure reducers 68 to the main vent line 67, whereas when valves 68 are opened, the compressed air flows from lines 66 through valves 69 and lines 70 to the main vent line 67.

In the stationary state, valves 61, 62, 63 and 64 are all disposed so that compressed air can is delivered to both ends of the chambers of both cylinders at the full pressure. If, for example, the piston in cylinder 144*a* has to be driven downwards relative to the circuit diagram, control valve 62 must be actuated, thus separating the bottom chamber of cylinder 144*a* from the compressed-air supply and connecting it to the vent. Compressed air will thus flow into the upper chamber via valve 61 and drive the piston downwards. The pneumatic cylinders 144*a* and 144*b* operate similarly. If the pistons of cylinders 144*a* and 144*b* are extended, arms 108 is raised, whereas if the pistons are retracted, the arm is lowered. If one piston is extended, whereas the other is retracted, or if the pistons are driven to a varying extent, e.g. one is extended somewhat more than the other, the arm will pivot.

A control valve 71 for actuating the motor 114 is disposed in compressed-air line 53. In the inoperative position, valve 71 blocks two compressed-air lines 72 and 73 leading to motor 114. In a first operating position of valve 71, line 53 is connected to line 72, thus actuating a drive element (not shown) of motor 114. In this position, line 73 is used for venting, and air flows along a vent line 74 to the main vent line 67. When valve 71 is moved over into the second operating position, compressed air is conveyed through line 73 and the drive element is actuated in the opposite direction, with venting through line 72. In this position of valve 71, line 72 is connected to a vent line 75, which likewise opens into line 67. If valve 71 is switched to both working positions alternately, the flow in lines 72 and 73 is reversed on each occasion, thus alternately moving the drive element of motor 114 and pivoting the nozzle 128. Pressure regulators 76 are disposed in vent lines 74 and 75.

Figure 6:
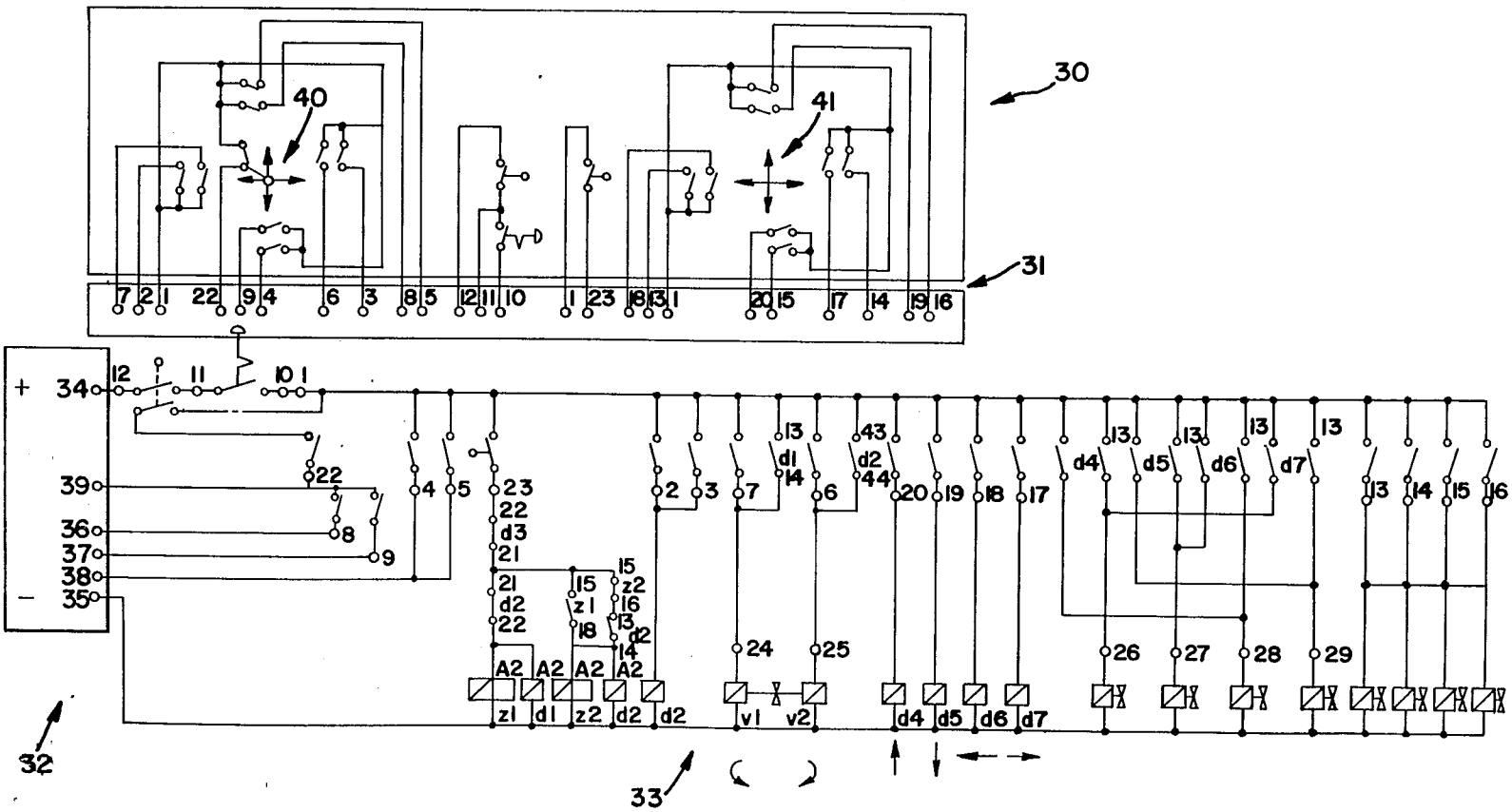

FIG. 6 shows the electric circuit of the device. It shows the main components, i.e. a control panel 30 having a main plug 31, an input panel 32 for the pallet truck, and a control box 33.

Input panel 32 has connections 34, 35 for general power supply. There is also a connection 36 for forward motion, a connection 37 for reverse motion, a connection 38 for moving the truck at increased speed, and a connection 39 for braking the truck.

In order to control the main operations of the device according to the invention, control panel 30 has levers 40, 41 which can be moved up and down or left and right. Lever 40 is moved up or down to control the motion of the truck, and to right or left to control the rotation of nozzle 128. When lever 41 is actuated, cylinders 144*a* and 144*b* are started up.

In the drawing of the main plug 31 and control box 33, similarly-numbered connections serve similar purposes.

In order to start up the device according to the invention, a circuit is closed by a key-operated switch. The switch is disposed in the control circuit between connections 10 and 11. The "emergency off" function is provided between connnections 11 and 12. When the switch between connections 10 and 11 or 11 and 12 is opened, the current between the positive terminal 34 and the negative terminal 35 is interrupted.

When lever 40 is moved upwards, the switch in the line to the connection 8 of the plug 31 is closed and moves the truck forward, in the manner shown from the diagram of control box 33. When lever 40 is moved further up, the switch to connection 5 is also closed, so that the truck moves forward at higher speed. When lever 40 is moved to the first position downwards, the truck is moved backward via connection 9, whereas when lever 40 is in the second position, the reverse speed is increased via connection 4. When lever 40 is pressed downwards (dead man's handle), the switch to connection 22 is closed and the safety brake is actuated. The brake is kept "on" when no current flows.

When lever 41 is moved upwards, the switch for connection 19 is closed, thus activating the relay d5 via the circuit in control box 33. Relay d5 actuates valves 62 and 63, thus retracting the pistons of cylinders 144*a* and 144*b* and pivoting arm 108 downwards. If the switch for connection 20 is closed by the control lever, relay d4 actuates valves 61 and 64, thus extending the pistons of cylinders 144*a* and 144*b* and raising arm 108. If the switch for connection 18 is actuated by lever 41, relay d6 is actuated and also valves 62 and 64, so that the piston of cylinder 144*a* is retracted, the piston of cylinder 144*b* is extended, and consequently arm 108 pivots to the left in the diagram in FIG. 5. If the switch to connection 17 is closed by lever 41, relay d7 and valves 61 and 63 are actuated, thus pivoting the arm to the right. If lever 41 is moved through the aforementioned positions to close the switch, the switches belonging to connections 13, 14, 15 or 16 are also closed, thus respectively actuating the control valves 69 and bridging the pressure regulators 68 so that the pistons of cylinder 144*a* or 144*b* are extended or retracted at higher speed.

When lever 40 is pushed to the right, the switch for connection 6 is closed and actuates coil v2, thus moving valve 71 from the rest position into a first operating position in which motor 114 is driven in a first direction of rotation, thus rotating the spray nozzle 128 in one direction. If lever 40 is moved in the opposite direction, the switch belonging to connection 6 is opened, whereas the switch belonging to connection 7 is closed, thus actuating valve v1 and switching the control valve 71 from a first working position to a second working piston in which motor 114 is driven in the opposite second direction and nozzle 128 is pivoted in the opposite direction.

The circuit according to the invention can be used for automatically driving nozzel 128 in reciprocation. To this end, the switch to connection 23 must first be closed. Next, lever 40 is pivoted to right or left until the switches belong to connection 2 or 3 are closed, thus actuating relay d3. Relay d3 closes the switch (also reference d3) disposed in switch-box 33. In the non-energized position, the switch d2 connected after switch d3 is in the closed state, so that both relay d1 and time relay z1 are energized. As a result of the energization of relay d1, the switch d1 in switch-box 33 is closed and actuates coil v1 of valve 71. After a predetermined time, time relay z1 closes switch zl and actuates a time relay z2. Simultaneously, a relay d2 is actuated, thus actuating the coil v2 of valve 71 and pivoting nozzle 128 into the opposite direction. As a result of the actuation of time relay z2 and relay d2, switches z2 and d2 are connected parallel to switch z1. Switch d2 is constructed as a lock-type contact, i.e. it closes only when switch z2 is also closed and relay d2 is actuated. After a certain time, time relay z1 opens switch z1 and current flows via switches z2 and d2. When switch z2 is no longer actuated, the current to relay d2 is interrupted and consequently switch d2 closes and time relay z1 and relay d1 are again actuated, so that coil v1 of valve 71 causes nozzle 128 to rotate in the opposite direction. When switch 23 is opened, the automatic spray nozzle is made inoperative. The same effect can be obtained by re-actuating the switches to connections 2 and 3. These re-actuated switches again actuate relay d3, thus opening switch d3.

Reference contact 1 denotes the power connections in main switch 31 and in control-box 32.

As can be appreciated from the above description, the spray machine constructed in accordance with the present invention can be produced at a minimum cost and can easily be manipulated into a confined space utilizing conventional commerically-available forklift-type trucks that are small and versatile. Since all the controls are electrically operable, remote control is much simpler.

While the invention has been particularly shown and described with reference to a preferred embodiment thereof, it will be understood by those skilled in the art that various changes in form and details may be made therein without departing from the spirit and scope of the invention.

I claim:

1. A spraying device including a stationary frame having a base, an arm universally pivoted at one end on said base and having a free end with an application nozzle on said free end, at least a pair of ground-engaging wheels on one end of said base, extensible support means on an opposite end of said base, and a three-wheel power driven truck including a drive wheel and a pair of retractable jack wheels, said truck having a movable fork, said one end of said base having slot means receiving a free end of said fork, said free end of said fork abutting a surface of said slot means to support said fork with said fork being in engagement with and supporting said base by said opposite end so that said extensible support means and retractable jack wheels can be retracted and said stationary frame and truck become one unit supported by said ground-engaging wheels and said drive wheel and said power driven truck can be used to position said application nozzle with respect to a working surface.

2. A spraying device as defined in claim 1, in which said base has extensible and retractable support means on an opposite end so that said stationary frame can be independently supported by said support means and said ground-engaging wheels.

3. A spraying device as defined in claim 2, in which said fork includes two transversely-spaced arms having said retractable jack wheels thereon so that said truck can be independently supported by said drive wheel and said jack wheels.

4. A spraying device as defined in claim 3, in which said base is generally rectangular and has retaining elements cooperating with retaining elements on said arms of said fork to retain said base on said fork.

5. A spraying device as defined in claim 1, in which said truck has electrically-operated drive means, further including remote control means for operating said drive means.

6. A spraying device as defined in claim 1, further including a pair of pneumatic working cylinders having one end connected to said arm and having opposite ends connected to said base at laterally spread positions to form a triangle on said base, said working cylinders being simultaneously actuated to pivot said application nozzle with respect to said stationary frame.

7. A spraying device as defined in claim 6, in which said arm has first and second parts rotatable relative to each other and pneumatic drive means on said arm for rotating said parts relative to each other.

8. A spraying device as defined in claim 7, further including heat shield means on said arm for protecting said pneumatic drive means and heat shield means on said base for protecting said working cylinders.

9. A spraying device as defined in claim 6, further including pneumatic cylinder means connected to said base and said arm providing a bracing force for said arm.

10. A spraying device comprising a stationary frame with an arm having one end pivoted for universal movement on said frame and a nozzle on an opposite end, two pneumatic working cylinders having one end pivotally connected to said frame at spaced-apart locations and opposite ends connected to said arm to form supporting triangle for said arm, said working cylinders being able to move said arm through any angle in space, a power-driven pallet truck having a movable fork thereon, said truck having a single steerable drive wheel and a pair of retractable jack wheels, said stationary frame including a base having wheels at one end and retractable support means at an opposite end with retaining elements adjacent said opposite end engagable with retaining elements on said fork, said base having slot means adjacent said one end receiving a free end of said fork so that said stationary frame can be coupled to the fork of said truck and moved by said truck, and said jack wheels and said retractable support means can be retracted so that said frame and truck are supported by said drive wheel and said wheels on said base.

11. A spraying device as defined in claim 10, in which said arm has first and second parts and pneumatic means for rotating said parts relative to each other.

12. A spraying device as defined in claim 10, in which said truck has an electrically-driven drive wheel with said drive wheel being pivoted to control the direction of said truck, said drive wheel being lockable in a centered position, and in which said pneumatic working cylinders are actuated by electrically-operated valve means, further including remote control means for controlling said valve means and said drive wheel for moving said truck and stationary frame in straight forward and rearward directions.

13. A spraying device as defined in claim 12, in which said fork includes a pair of arms with said retractable jack wheels carried by said arms and being extensible to support said truck on said drive wheel and said jack wheels.

14. A spraying device as defined in claim 12, in which said arm includes first and second parts and a pneumatic drive means for rotating said parts relative to each other.

* * * * *